US005692374A

United States Patent [19]

Seki et al.

[11] Patent Number: 5,692,374

[45] Date of Patent: Dec. 2, 1997

[54] EXHAUST SYSTEM OF INTERNAL COMBUSTION ENGINE

[75] Inventors: Koji Seki; Yukio Nakanishi; Tanomo Norikawa, all of Tokyo, Japan

[73] Assignee: Calsonic Corporation, Tokyo, Japan

[21] Appl. No.: 552,797

[22] Filed: Nov. 3, 1995

[30] Foreign Application Priority Data

Nov. 4, 1994 [JP] Japan ..... 6-270967

[51] Int. Cl.[6] ..... F01N 7/00

[52] U.S. Cl. ..... 60/312; 60/324

[58] Field of Search ..... 60/312, 324

[56] References Cited

U.S. PATENT DOCUMENTS

| | | |
|---|---|---|
| 2,072,372 | 3/1937 | Kingsley . |
| 3,751,921 | 8/1973 | Blomberg et al. . |
| 4,320,815 | 3/1982 | Norris . |
| 4,665,692 | 5/1987 | Inaba . |

FOREIGN PATENT DOCUMENTS

| | | |
|---|---|---|
| 0 329 165 A3 | 8/1989 | European Pat. Off. . |
| B-2111000 | 11/1972 | Germany . |
| 2-259217 | 10/1990 | Japan . |
| 3-185209 | 8/1991 | Japan . |
| 4-124418 | 4/1992 | Japan . |

OTHER PUBLICATIONS

Patent Abstracts of Japan, publication No. JP2136504, publication date—May 5, 1990 vol. 14, No. 375, Yosuke.

European Search Report—EP 95 11 7356, Feb. 12, 1996.

*Primary Examiner*—Douglas Hart

*Attorney, Agent, or Firm*—Foley & Lardner

[57] ABSTRACT

An exhaust system of an internal combustion engine has an exhaust gas inlet tube extending from the engine. A muffler is connected at its inlet side to the exhaust gas inlet tube. The muffler includes first and second exhaust gas flowing passages. First and second exhaust gas outlet tubes are respectively connected to the first and second exhaust gas flowing passages and extend from the muffler independently. A flow controller steplessly varies the flow passage area of the second exhaust gas outlet tube in accordance with the pressure of the exhaust gas discharged from the engine. The flow controller continuously increases the flow passage area with increase of the magnitude of the exhaust gas pressure.

8 Claims, 6 Drawing Sheets

EXHAUST SYSTEM OF INTERNAL COMBUSTION ENGINE

BACKGROUND OF THE INVENTION

1. Field of the Invention

The present invention relates in general to exhaust systems of an engine, and more particularly to exhaust systems of an automotive internal combustion engine. More specifically, the present invention is concerned with the exhaust systems of a controllable type including a muffler, which muffles the exhaust gas from the engine, and a muffler controller, which can control the performance of the muffler, thereby controlling the pressure and sound of the exhaust gas.

2. Description of the Prior Art

For muffling the exhaust gas emitted from an automotive internal combustion engine, various types of exhaust systems have been proposed and put into practical use. Some of them are of a controllable type comprising a muffler for muffling the exhaust gas and a muffler controller for controlling the performance of the muffler. Some of the muffler controllers are of a type that includes a valve for opening and closing a certain exhaust passage of the muffler and an actuator for actuating the valve. These muffler controllers are shown in Japanese Patent First Provisional Publications Nos. 3-185209, 4-124418 and 2-259217.

However, due to inherent construction, the conventional exhaust systems of the above-mentioned controllable type have failed to exhibit a satisfied performance in optimally muffling the exhaust gas. Furthermore, some are highly costly due to their complicated construction and costly parts inevitably used therein.

SUMMARY OF THE INVENTION

It is therefore an object of the present invention to provide a controllable exhaust system of an internal combustion engine, which system is free of the above-mentioned drawbacks.

According to the present invention, there is 10 provided a controllable exhaust system of an internal combustion engine, which system can exhibit a satisfied muffling performance against the exhaust gas without sacrificing the performance of the engine.

According to the present invention, there is further provided a controllable exhaust system of an internal combustion engine, which system is low in cost, simple in construction, and compact in size.

According to the present invention, there is provided an exhaust system of an internal combustion engine, which system comprises an exhaust gas inlet tube extending from the engine; a muffler connected at its inlet side to the exhaust gas inlet tube, the muffler including first and second exhaust gas flowing passages; first and second exhaust gas outlet tubes respectively connected to the first and second exhaust gas flowing passages and extending from the muffler independently; and means for steplessly varying the flow passage area of the second exhaust gas outlet tube in accordance with the pressure of the exhaust gas discharged from the engine, the means continuously increasing the flow passage area with increase of the magnitude of the exhaust gas pressure.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
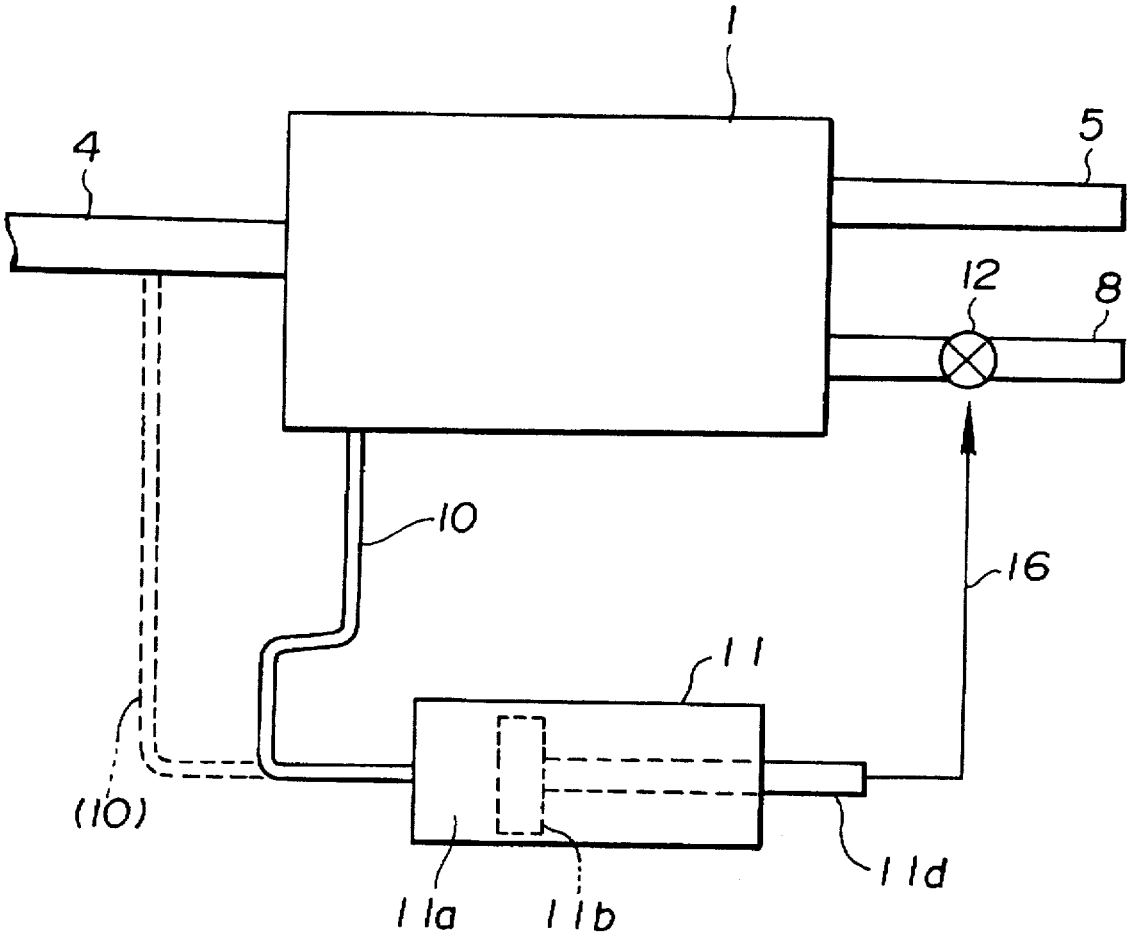
FIG. 1 is a schematic view of a controllable exhaust system of an internal combustion engine, according to the present invention.
Figure 2:
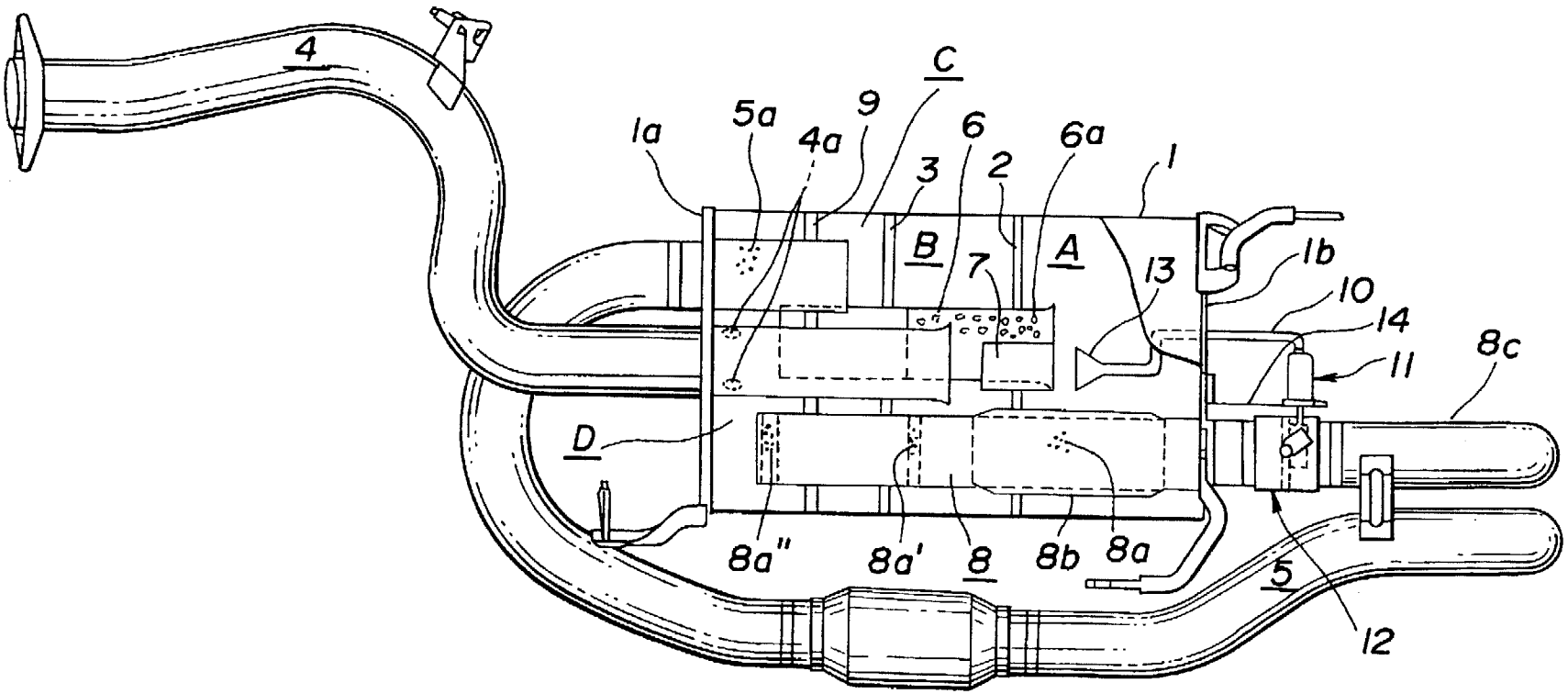
FIG. 2 is a partially sectioned plan view of the controllable exhaust system of the invention.
Figure 3:
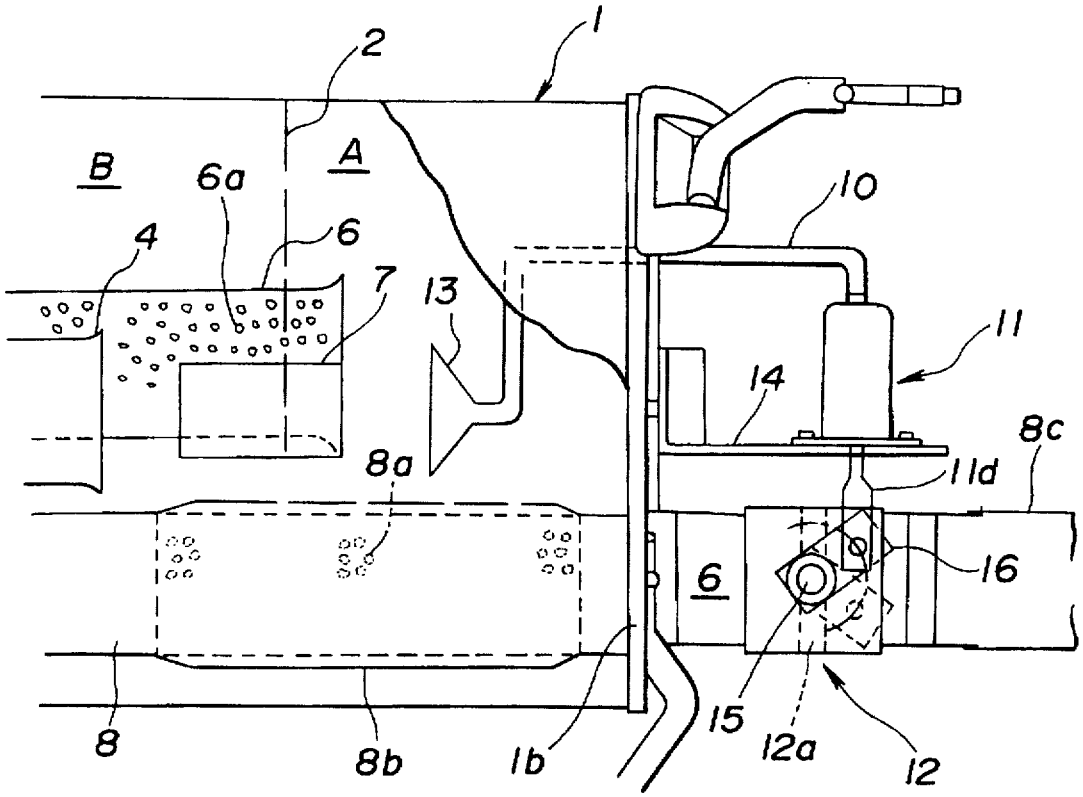
FIG. 3 is an enlarged view of an essential portion of the controllable exhaust system of the invention.

Referring to FIGS. 1 to 4, particularly FIGS. 2 and 3, there is shown a controllable exhaust system according the present invention.

In FIGS. 2 and 3, denoted by numeral 1 is an exhaust muffler. Three partition walls 2, 3 and 9 are arranged in the muffler 1 to divide the interior of the same into four chambers "A", "B", "C" and "D". Denoted by numeral 4 is an exhaust gas inlet tube having a rear end portion projected into the muffler 1. First and second exhaust gas outlet tubes 5 and 8 extend from the interior of the muffler 1. Denoted by numerals 6 and 7 are longer and shorter intermediate tubes installed in the muffler 1.

Denoted by numeral 10 is a pressure induction pipe, 11 is a cylinder type actuator and 12 is a control valve, which constitute a muffler controller as will be described in detail hereinafter.

The chamber "A" is defined between a rear wall 1b of the muffler 1 and the partition wall 2, the chamber "B" is defined between the partition wall 2 and the partition wall 3, the chamber "C" is defined between the partition wall 3 and the partition wall 9, and the chamber "D" is defined between a front wall la of the muffler 1 and the partition wall 9, as shown. As will become apparent as the description proceeds, the three chambers "A", "B" and "D" are expansion chambers, and the chamber "C" is a resonance chamber.

The exhaust gas inlet tube 4 has a front open end connected to an exhaust manifold (not shown) of an internal combustion engine or a catalytic converter (not shown). The rear end portion of the tube 4 passes through the chambers "D" and "C" having a rear open end thereof exposed to the chamber "B". The rear end portion of the tube 4 is formed, at a part exposed to the chamber "D", with four small openings **4*a*. Each opening 4*a* is about 10 mm in diameter. Thus, the exhaust gas flowing in the exhaust gas inlet tube 4 can flow into the chamber "B" through the rear open end and into the chamber "D" through the four small openings 4*a***.

The first exhaust gas outlet tube 5 has a front end portion projected into the muffler 1 from the front wall **1*a* of the muffler 1. That is, the front end portion of the tube 5 passes through the chamber "D" having a front open end thereof exposed to the chamber "C" The front end portion is formed, at a part exposed to the chamber "D", with a plurality of small openings 5***a*. Each opening 5*a* is about 4 mm in diameter. Thus, the exhaust gas in the chamber "D" can flow into the first exhaust gas outlet tube 5 through the small openings 5*a*.

The second exhaust gas outlet tube 8 has a front half portion projected into the muffler 1 from the rear wall 1*b* of the muffler 1. That is, the front half portion of the tube 8 passes through the chambers "A", "B" and "C" having a front open end thereof exposed to the chamber "D". A rear half portion 8*c* of the tube 8, which is exposed to the open air, is provided with the above-mentioned control valve 12. The front half portion of the tube 8 is formed, at parts exposed to the chambers "B" and "D", with a plurality of small openings 8*a'* and 8*a"*. Each opening 8*a'* or 8*a"* is about 3 mm in diameter. Thus, the exhaust gas in the chamber "B" can flow into the tube 8 through the small openings 8*a'* and the exhaust gas in the chamber "D" can flow into the tube 8 through both the front open end and the small openings 8*a"*. The front half portion of the tube 8 is formed, at a part exposed to the chamber "A", with a plurality of small openings 8*a*. This perforated part of the tube 8 is wrapped with an outer cover 8*b*. A glass wool is packed in a cylindrical space defined between the perforated part and the outer cover 8*b*. Due to provision of the outer cover 8*b*, there is no direct communication between the chamber "A" and the tube 8.

The longer intermediate tube 6 passes through the chambers "B" and "C" to communicate the chambers "A" and "D". The longer intermediate tube 6 is formed, at a part exposed to the chamber "B", with a plurality of small openings 6*a*. Each opening 6*a* is about 4 mm in diameter. Thus, the chambers "A", "B" and "D" are communicated by the longer intermediate tube 6. Due to provision of the openings 6*a*, the exhaust gas led into the chamber "B" can flow into the longer intermediate tube 6.

The shorter intermediate tube 7 passes through the partition wall 2 to communicate the chambers "A" and "B". It is to be noted that the shorter intermediate tube 7 is aligned with the rear end portion of the exhaust gas inlet tube 4 projected into the muffler 1, as shown.

As is best shown in FIG. 3, the pressure induction pipe 10 has a tapered open end 13 led into the chamber "A". As shown, the tapered open end 13 of the pipe 10 faces the rear end of the shorter intermediate tube 7. That is, the rear end portion of the exhaust gas inlet tube 4, the shorter intermediate tube 7 and the tapered open end 13 are collinearly aligned, in the illustrated manner. The other open end of the pipe 10 is connected to the cylinder type actuator 11. Thus, the positive pressure consisting of static and dynamic pressures created in the chamber "A" of the muffler 1 is led into the actuator 11.

Figure 4:
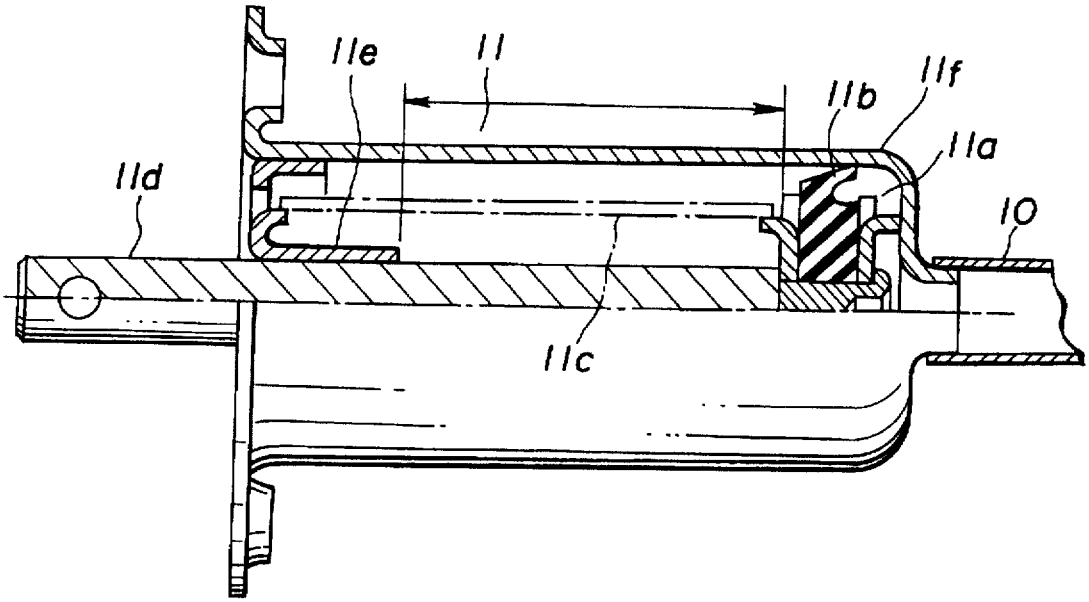
FIG. 4 is a partially sectioned view of a cylinder type actuator employed in the present invention.

As is seen from FIG. 4, the actuator 11 comprises a cylindrical casing 11*f*, an annular piston 11*b* slidably received in the casing 11*f* to define a work chamber 11*a*, a coil spring 11*c* installed in the casing 11*f* to bias the annular piston 11*b* rightward in the drawing, a piston rod 11*d* extending from the annular piston 11*b* and projected to the outside of the casing 11*f*, and a stopper 11*e* installed in the casing 11*f* to stop excessive displacement of the piston 11*b*. The work chamber 11*a* is connected to the other open end of the pressure induction pipe 10. Thus, when the positive pressure is led into the work chamber 11*a* through the pipe 10, the piston 11*b* is slid leftward in FIG. 4 against the biasing force of the spring 11*c* thereby pushing out the piston rod 11*d*.

Referring back to FIG. 3, the cylinder type actuator 11 is mounted on a bracket 14 secured to the rear wall 1*b* of the muffler 1o The piston rod 11*d* of the actuator 11 is operatively connected to the control valve 12.

The control valve 12 comprises a butterfly plate 12*a* pivotally installed through a pivot shaft 15 in the exposed rear half portion 8*c* of the second exhaust gas outlet tube 8. The pivot shaft 15 is connected through a link 16 to the piston rod 11*d* of the actuator 11. Thus, when, due to application of positive pressure to the actuator 11, the piston rod 11*d* is pushed out, the butterfly plate 12*a* is pivoted in a direction to open and increase the flow passage area of the second exhaust gas outlet tube 8.

It is to be noted that the open degree of the butterfly plate 12*a* (viz., the flow passage area of the tube 8) is continuously varied in accordance with the magnitude of the positive pressure fed to the actuator 11.

Thus, it will be appreciated that when the engine is under a low load condition, such as idling or the like, the butterfly plate 12*a* keeps its closed position due to the work of the biasing coil spring 11*c* of the actuator 11. In fact, the coil spring 11*c* is so set as to permit the rod-pushing movement of the piston 11*b* when the engine runs at a speed higher than 1500 rpm.

In the following, operation of the controllable exhaust system of the invention will be described.

For ease of understanding, the description will be commenced with respect to a standstill condition of the engine.

Under this rest condition, the butterfly plate 12*a* of the control valve 12 assumes its closed position thereby fully closing the flow passage of the second exhaust gas outlet tube 8.

When now the engine is started, the exhaust gas from the engine is fed into the muffler 1 through the exhaust gas inlet tube 4. The exhaust gas in the muffler 1 travels in order the chamber "B", the shorter intermediate tube 7, the chamber "A", the longer intermediate tube 6 and the chamber "D" and travels the first exhaust gas outlet tube 5 before being discharged to the open air. During traveling in the muffler 1, the exhaust gas looses its energy due to the above-mentioned unique arrangement of the chambers "A", "B", "C" and "D" and the shorter and longer intermediate tubes 7 and 6.

When the engine speed is increased by depressing an accelerator pedal, the pressure of the exhaust gas is increased accordingly.

When the engine speed is further increased and comes to a certain level, for example, about 1500 rpm, the butterfly plate 12*a* of the control valve 12 starts to open for the reason stated above. Upon this, the second exhaust gas outlet tube 8 becomes operative but partially. That is, in addition to the exhaust gas flow directed toward the first exhaust gas outlet tube 5, the muffler 1 produces another exhaust gas flow directed toward the second exhaust gas outlet tube 8, which flow comprises a gas flow from the chamber "B" to the tube 8 through the small openings 8*a'* and a gas flow from the chamber "D" to the tube 8 through both the front open end of the tube 8 and the small openings 8*a"*.

When the engine speed is further increased, the butterfly plate 12*a* increases its opening degree. Thus, the resistance of the muffler 1 against the flow of the exhaust gas flowing therein is reduced.

Advantages of the present invention will become apparent from the following description.

OPEN/CLOSE OPERATION OF CONTROL VALVE 12

Under operation of the engine, a certain positive pressure is created in the chamber "A" of the muffler 1 and the pressure is thus fed to the work chamber 11*a* of the actuator 11. In accordance with the magnitude of the pressure fed to the actuator 11, the butterfly plate 12*a* of the control valve 12 is continuously pivoted varying the flow passage area of the second exhaust gas outlet tube 8.

Figure 5:
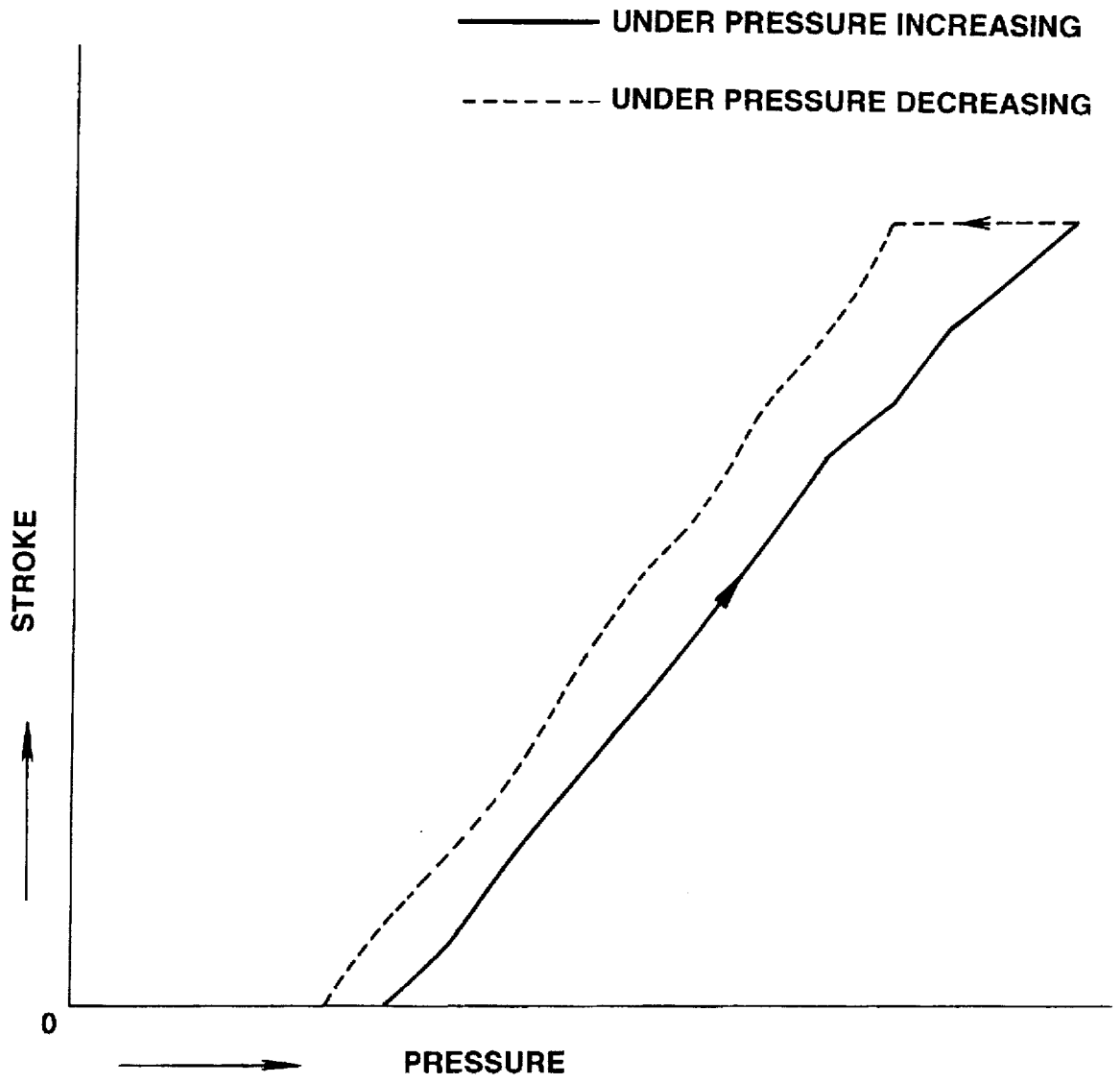
FIG. 5 is a graph showing the characteristic of the cylinder type actuator in terms of the relationship between a pressure applied to the actuator and a piston stroke of the actuator.

The stroke characteristic of the piston rod 11*d* of the actuator 11 with respect the magnitude of the positive pressure fed to the actuator 11 is shown in the graph of FIG. 5. As is seen from this graph, the stroke characteristic of the piston rod 11*d* obtained when the pressure in the work chamber 11*a* is increasing is different from that of the piston rod 11*d* obtained when the pressure in the work chamber 11*a* is decreasing. That is, the stroke of the piston rod 11*d* has a hysteresis between the pressure increasing mode and the pressure decreasing mode of the actuator 11. This is because of an inevitable friction of the piston 11*b* against the inner wall of the casing 11*f* of the actuator 11. Accordingly, when the pressure in the work chamber 11*a* varies within a small range, the hysteretic pressure range can serve as a non-working zone and thus the undesired hunting of the control valve 12, which would occur when the butterfly plate 12*a* makes the opening and closing movement, can be eliminated.

Since the tapered open end 13 of the pressure induction pipe 10 is arranged to face the rear end of the shorter intermediate tube 7, the pipe 10 can catch the dynamic pressure of the exhaust gas as well as the static pressure of the same. This means a certain increase in pressure level of the positive pressure fed to the actuator 11, and thus the valve actuating operation of the actuator 11 is assured.

PRESSURE REGULATING FUNCTION

Under operation of the engine, the exhaust gas is discharged from the engine with a certain pressure fluctuation varied in accordance with the speed of the engine. Thus, if such exhaust gas is directly fed to the actuator 11, the movement of the piston rod 11*d* would be severely affected by the pressure fluctuation. In fact, the opening and closing movement of the butterfly plate 12*a* of the control valve 12 would be fluctuated in such case.

However, in the invention, such apprehension is eliminated by positioning the tapered open end 13 of the pipe 10 at the chamber "A", which is an expansion chamber. As is known, when the exhaust gas is led into such expansion chamber, the pressure fluctuation of the same is reduced and thus the pressure in the chamber "A" is regulated. This pressure regulating function becomes most effective when the engine is under a low speed operation. If a thinner pressure induction pipe 10 is employed, much regulated positive pressure can be obtained from the exhaust gas.

OPERATION OF CONTROL VALVE 12 UNDER ACCELERATION OF ENGINE

When, for accelerating the vehicle, the accelerator pedal is depressed and thus the speed of the engine increases, the pressure of the exhaust gas is increased. With this, the positive pressure in the chamber "A" of the muffler 1 and thus the pressure in the work cheer 11*a* of the actuator 11 is increased. With this, the butterfly plate 12*a* of the control valve 12 is turned from the closed position toward the full open position. Since the turning of the butterfly plate 12*a* is continuously and steplessly effected, smoothed acceleration of the vehicle as well as ear-agreeable exhaust sound is obtained.

Figure 6:
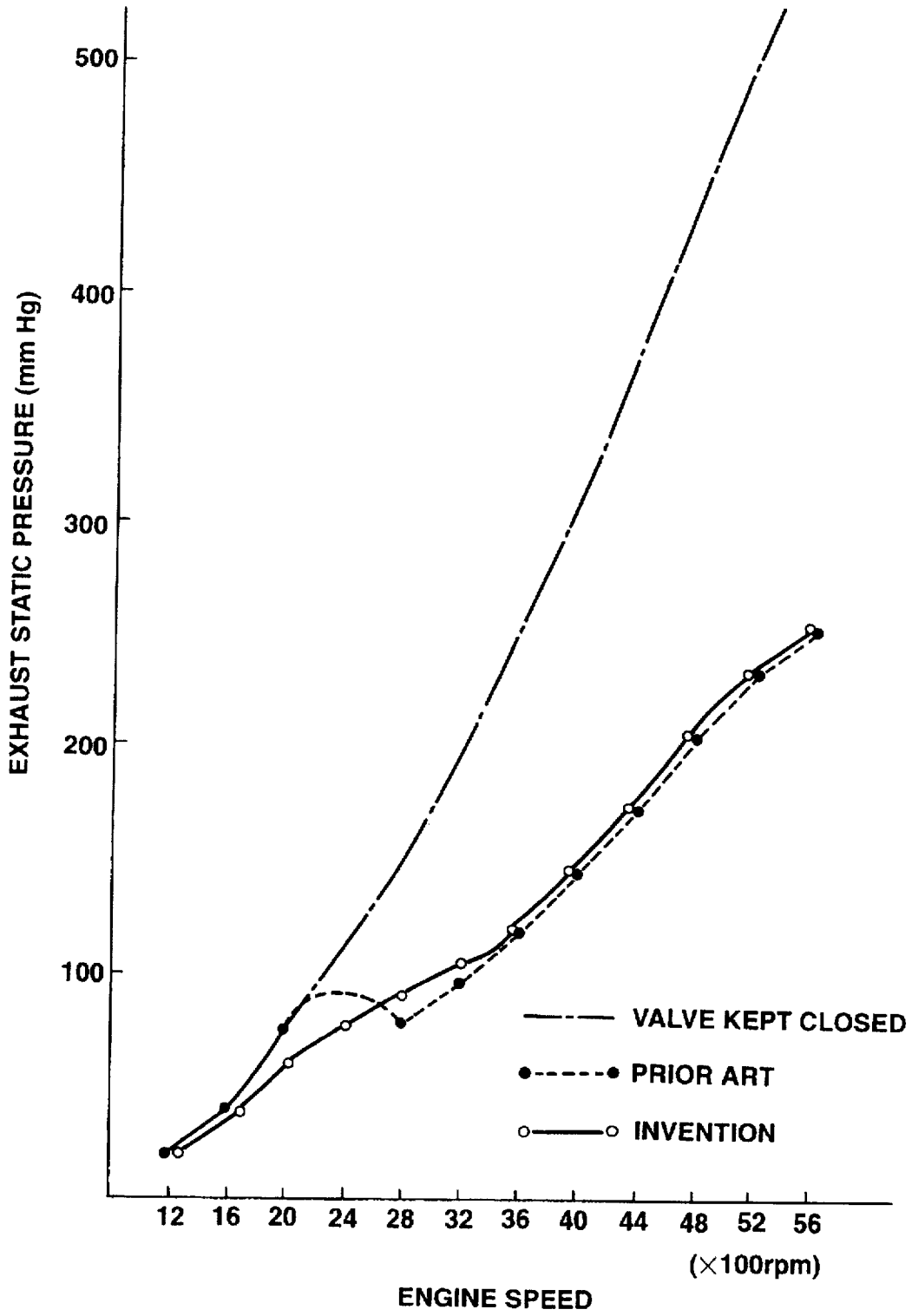
FIG. 6 is a graph showing both an exhaust pressure control performance exhibited by the exhaust system of the invention and that exhibited by a conventional exhaust system, the performance being depicted in terms of the relationship between a static pressure of the exhaust gas and an engine speed.
Figure 7:
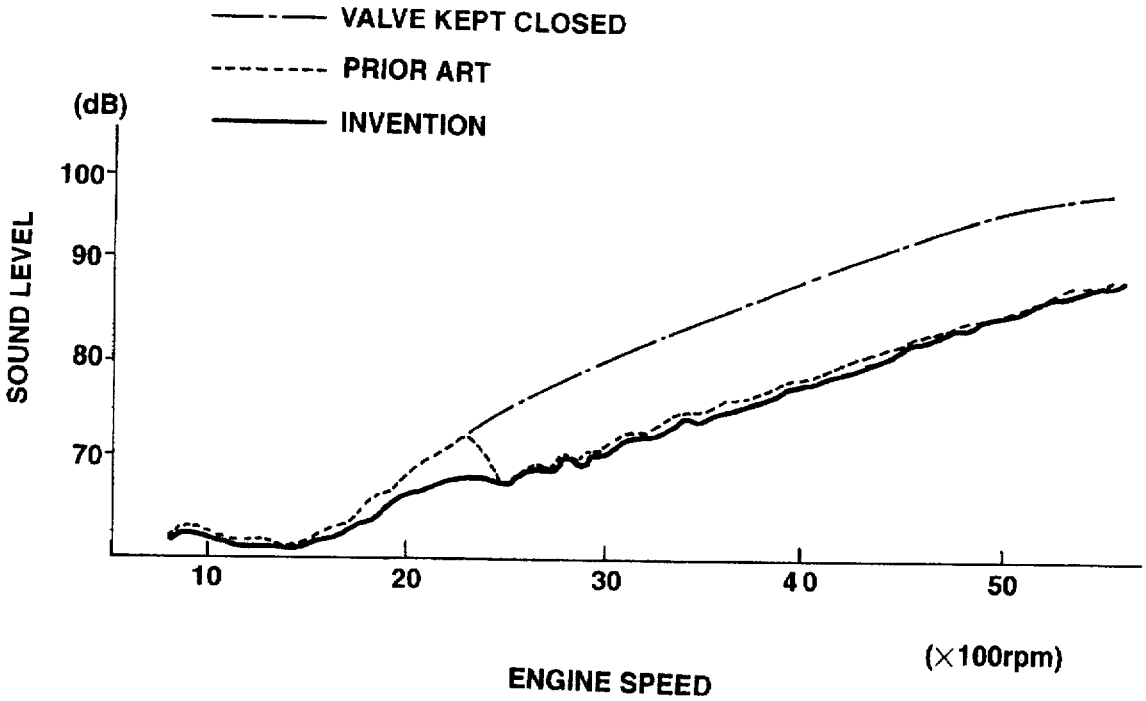
FIG. 7 is a graph showing both an exhaust sound controlling performance exhibited by the exhaust system of the invention and that exhibited by the conventional exhaust system, the performance being depicted in terms of the relationship between an exhaust sound and the engine speed.

These advantageous phenomena will be readily understood from the graphs of FIG. 6 and FIG. 7.

FIG. 6 shows both an exhaust pressure control performance exhibited by the exhaust system of the invention and that exhibited by a conventional exhaust system. In the conventional exhaust system, an ON/OFF type control valve is employed, which controls a valve proper in ON/OFF manner, so that the valve proper takes only a fully closed position and a fully open position.

As is seen from this graph, in the conventional exhaust system (whose characteristic is depicted by the curve of dotted line), the exhaust static pressure is suddenly but temporarily dropped at a certain engine speed (viz., about 2400 rpm) during the time when the engine speed is increasing. The sudden drop is produced when the valve proper changes its position from the fully closed position to the fully open position. Of course, in this case, smoothed acceleration of a vehicle is not expected. However, in the exhaust system of the present invention (whose characteristic is depicted by the curve of solid line), such undesired pressure drop does not appear. This is because of usage of the steplessly openable butterfly plate 12*a* of the control valve 12. As has been described hereinabove, in the present invention, the butterfly plate 12*a* can vary the open degree in the second exhaust gas outlet tube 8. That is, with increase of engine speed, the exhaust static pressure increases substantially linearly, and due to the gradual opening of the butterfly plate 12, the exhaust resistance is gradually decreased, which provides the vehicle with a smoothed acceleration.

The curve illustrated by a phantom line shows a case wherein the butterfly valve 12*a* (or valve proper) is kept closed throughout the increase in engine speed.

FIG. 7 shows both an exhaust sound controlling performance exhibited by the exhaust system of the invention and that exhibited by the conventional exhaust system.

As is seen from this graph, in the conventional exhaust system (whose characteristic is depicted by the curve of dotted line), the exhaust sound is suddenly but temporarily dropped at the certain engine speed (viz., about 2400 rpm) during increase in engine speed. This sound drop is not agreeable to the ear. However, in the exhaust system of the present invention (whose characteristic is depicted by the curve of solid line), such undesired sound drop does not appear. Thus, in the invention, ear-agreeable exhaust sound is obtained.

The curve illustrated by a phantom line shows a case wherein the butterfly valve 12*a* (or valve proper) is kept closed throughout the increase in engine speed.

APPLICATION TO MOTOR VEHICLE

In the invention, the exhaust gas from the engine is used as a power for driving the control valve 12. Thus, the exhaust system of the invention can be manufactured at low cost as compared with other exhaust systems where electric actuators are used for actuating the control valve.

In the following, modifications of the present invention will be described.

If desired, for feeding the actuator 11 with a positive pressure, the pressure induction pipe 10 may be connected to the exhaust gas inlet tube 4, as is shown in FIG. 1 by a dotted line. However, in this case, the above-mentioned pressure regulating function exclusively possessed by the expansion chamber in the muffler 1 is not expected.

If desired, a shutter type valve plate may be used in place of the butterfly plate 12*a*, so long as it can vary the open degree continuously.

If desired, a negative pressure created by using the exhaust pressure from the engine may be used for driving the actuator 11.

What is claimed is:

1. An exhaust system of an internal combustion engine, comprising:

an exhaust gas inlet tube extending from said engine;

a muffler connected at an inlet side thereof to said exhaust gas inlet tube, said muffler including first and second exhaust gas flowing passages, and at least one expansion chamber;

first and second exhaust gas outlet tubes respectively connected to said first and second exhaust gas flowing passages and extending from said muffler independently; and means for steplessly varying the flow passage area of said second exhaust gas outlet tube in accordance with the pressure of the exhaust gas discharged from the engine, said means continuously increasing said flow passage area with increase of the magnitude of the exhaust gas pressure, wherein the steplessly varying means comprises:

a control valve operatively disposed in said second exhaust gas outlet tube;

a cylinder type actuator for actuating said control valve in a direction to increase said flow passage area when fed with a pressurized gas; and a pressure induction pipe for feeding the pressurized gas to said actuator, said pressure induction pipe having a pressure inlet end exposed to said one expansion chamber.

2. An exhaust system as claimed in claim 1, wherein said pressure inlet end faces against the flow of the exhaust gas.

3. An exhaust system as claimed in claim 2, wherein said pressure inlet end is tapered, with an enlarged open end.

4. An exhaust system as claimed in claim 1, wherein said cylinder type actuator comprises:

a cylindrical casing;

an annular piston slidably received in said casing to define a work chamber, said work chamber being connected to said pressure induction pipe, so that when the pressure of the exhaust gas is led to said work chamber, said annular piston is moved in a first direction in the cylindrical casing;

a coil spring for biasing said annular piston in a second direction, which is opposite to said first direction; and a piston rod connected to said annular piston to move therewith and projected to the outside of the cylindrical casing, said piston rod being operatively connected to said control valve.

5. An exhaust system as claimed in claim 4, wherein said control valve comprises:

a butterfly plate;

a pivot shaft through which said butterfly plate is pivotally installed in said second exhaust gas outlet tube; and a link pivotally connecting said pivot shaft to said piston rod of said actuator.

6. An exhaust system of an internal combustion engine, comprising:

an exhaust gas inlet tube extending from said engine;

a muffler connected at an inlet side thereof to said exhaust gas inlet tube, said muffler including first and second exhaust gas flowing passages;

first and second exhaust gas outlet tubes respectively connected to said first and second exhaust gas flowing passages and extending from said muffler independently; and means for steplessly varying the flow passage area of said second exhaust gas outlet tube in accordance with the pressure of the exhaust gas discharged from the engine, said means continuously increasing said flow passage area with increase of the magnitude of the exhaust gas pressure, wherein the steplessly varying means comprises:

a control valve operatively disposed in said second exhaust gas outlet tube;

a cylinder type actuator for actuating said control valve in a direction to increase said flow passage area when fed with a pressurized gas, wherein said cylinder type actuator is connected to a rear wall of said muffler through a bracket; and a pressure induction pipe for feeding the pressurized gas to said actuator.

7. An exhaust system as claimed in claim 3, wherein the tapered pressure inlet end of said pressure induction pipe is positioned just downstream of a trailing end of said exhaust gas inlet tube, said trailing end being projected into the muffler.

8. An exhaust system of an internal combustion engine, comprising:

an exhaust gas inlet tube extending from the engine;

a muffler connected at an inlet side thereof to the exhaust gas inlet tube, the muffler including first and second exhaust gas flowing passages;

first and second exhaust gas outlet tubes respectively connected to the first and second exhaust gas flowing passages and extending from the muffler independently;

a control valve operatively disposed in the second exhaust gas outlet tube;

a cylinder type actuator for actuating the control valve in a direction to increase the flow passage area when fed with pressurized gas; and a pressure induction pipe for feeding the pressure of the exhaust gas to the cylinder type actuator, wherein the cylinder type actuator comprises:

a cylindrical casing;

an annular piston slidably received in the cylindrical casing to define a work chamber, the work chamber being connected to the pressure induction pipe, so that when the pressure of the exhaust gas is led to the work chamber, the annular piston is moved in a first direction in the cylindrical casing;

a coil spring for biasing the annular piston in a second direction, which is opposite to the first direction; and a piston rod connected to the annular piston to move therewith and projected to the outside of the cylindrical casing, the piston rod being operatively connected to the control valve.

* * * * *